US007610663B2

(12) United States Patent
Johnson, Sr.

(10) Patent No.: US 7,610,663 B2
(45) Date of Patent: Nov. 3, 2009

(54) STRUCTURE AND METHOD FOR CONNECTING CREMATION ASHES WITH LIVING PLANTS

(76) Inventor: Raymond Keith Johnson, Sr., P.O. Box 449, Barre, VT (US) 05641

( * ) Notice: Subject to any disclaimer, the term of this patent is extended or adjusted under 35 U.S.C. 154(b) by 623 days.

(21) Appl. No.: 11/542,709

(22) Filed: Oct. 4, 2006

(65) Prior Publication Data

US 2008/0083102 A1 Apr. 10, 2008

(51) Int. Cl.
*A61G 17/00* (2006.01)

(52) U.S. Cl. ..... 27/1; 47/58.1 R

(58) Field of Classification Search ..... 27/1; D99/5; 47/1.01 R, 66.6, 58.1, 8; 119/428
See application file for complete search history.

(56) References Cited

U.S. PATENT DOCUMENTS 2,069,580 A * 2/1937 Gaskins, Jr. ..... 47/65.7
4,977,652 A 12/1990 Graham
5,259,141 A * 11/1993 D'Alessandro ..... 47/39
5,461,824 A * 10/1995 Cassell ..... 47/57.5
5,701,642 A 12/1997 Order
5,774,958 A 7/1998 Casimir
5,799,488 A 9/1998 Truong
5,815,897 A 10/1998 Longstreth
5,867,938 A * 2/1999 DiLernia ..... 47/65.5
5,903,961 A * 5/1999 Parker et al. ..... 27/1
6,374,542 B1 * 4/2002 Polito ..... 47/79
6,477,983 B1 * 11/2002 Bette ..... 119/428
6,516,501 B2 2/2003 Vazquez-Perez
7,272,874 B2 * 9/2007 Staab ..... 27/1
2003/0066172 A1 4/2003 Parker

FOREIGN PATENT DOCUMENTS

FR 2868944 * 10/2005
JP 20011245941 * 9/2001
JP 2006068235 * 3/2006

* cited by examiner

*Primary Examiner*—William L. Miller
(74) *Attorney, Agent, or Firm*—Thomas G. Ference

(57) ABSTRACT

A structure for connecting cremation ashes with living plants comprising a plant and at least one from the group consisting of cremated remains in a cavity of the plant and a link located in a cavity of the plant, the link connecting with the cremated remains. The structure may further comprise a vessel for holding the cremated remains and a memorial structure connected to the link. The structure is meant to create a living memorial for the deceased.

33 Claims, 12 Drawing Sheets

STRUCTURE AND METHOD FOR CONNECTING CREMATION ASHES WITH LIVING PLANTS

FIELD OF THE INVENTION

This invention relates generally to structures and methods used for preserving and memorializing the remains of humans and animals. In particular, the present invention is directed to providing a crematory urn assembly that connects ash remains with a living plant.

BACKGROUND OF THE INVENTION

The popularity of cremation is growing within modern society as an alternative to preserving bodies and burying them in coffins. Cremation is also becoming a popular method of dealing with pet remains. Cremation is usually less expensive and more ecological than burial. It also offers living individuals an opportunity to keep some of the deceased's ashes close to them. Often a memorial is created at the location of the cremated remains to commemorate the deceased's life and provide a focal point to connect with the deceased's spirit.

In death, many individuals wish to continue a connection or link to the living world. This connection may be spiritual between the deceased and their relatives or the connection may take a more physical form such as between the deceased's remains and nature. For example, the deceased may wish to have their remains incorporated into a living tree. U.S. Pat. No. 5,799,488 to Truong and U.S. Pat. No. 6,516,501 to Vázquez-Pérez both propose mixing ashes with soil and planting a tree that will grow from the mixture. A plaque may be attached to the tree to identify specific remains with a specific tree. In a similar approach, U.S. Pat. No. 5,815,897 to Longstreth provides for a planter having a vault for holding cremation remains. The plant grows near the ashes, but the plant is not integrally linked to the ashes.

The above mentioned options offer some degree of integration between a particular deceased's ashes and a particular living tree or plant. These options, however, do not address other possibilities for connecting with a plant such as entombment of the remains within the plant, multiple connections of multiple individual's remains with a single plant, or temporary links to a plant allowing for future movement of the ashes. Furthermore prior art options do not provide for both the integration of the ash remains with a plant and an additional connection for a loved one to connect with the ashes.

SUMMARY OF THE INVENTION

One aspect of the present invention is directed to a structure for connecting cremated remains to a living plant comprising a plant and at least one from the group consisting of cremated remains in a cavity and a link located in a cavity, the link connects with the cremated remains.

Another aspect is directed to a structure for connecting cremated remains to a living plant comprising a vessel for holding cremated remains and a cavity cut within the plant, the vessel at least partially contained within the cavity.

Another aspect is directed to a structure for connecting cremated remains to a living plant comprising a vessel containing cremated remains and a link with first and second ends. The first end of the link is in contact with the remains and the second end of the link is for placement in a cavity cut within the plant.

Yet another aspect is directed to a method of connecting cremated remains to a living plant comprising forming a cavity in a living plant and at least one from the group consisting of placing cremated remains in the cavity and providing a link connecting the cremated remains with the cavity.

Still another aspect is directed to a method of connecting cremated remains to a living plant comprising providing a vessel containing the remains; creating a cavity within a portion of the plant; placing the vessel within the cavity; and allowing the plant to grow around the vessel.

Still yet another aspect is directed to a method of connecting cremated remains to a living plant comprising providing a vessel containing the remains, the vessel including a link with first and second ends, the first end in contact with the remains and the second end extending outward from the vessel; creating a cavity within a portion of the plant; placing the second end within the opening; and allowing the plant to grow around the second end to create a connection between the plant and the remains.

BRIEF DESCRIPTION OF DRAWINGS

The foregoing and other aspects and advantages of the invention will be apparent from the following detailed description of the invention, as illustrated in the accompanying drawings, in which.

DETAILED DESCRIPTION OF THE INVENTION

The present invention provides for a structure and method of connecting cremation remains with living plants. Although most of the embodiments are illustrated as occurring between cremation remains and a living tree, it is understood that other plants could be substituted for the tree and achieve the same results. The plant could be any plant including, but not limited to a tree, a cactus, a vine or a houseplant.

Figure 1A:
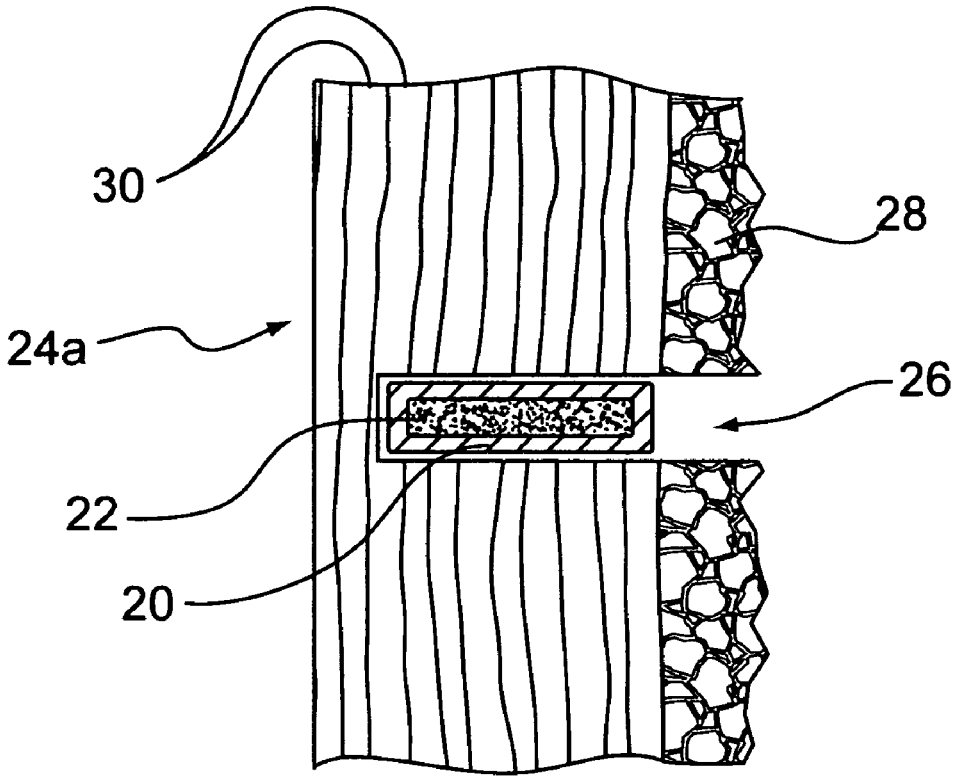
FIG. 1*a* is a sectional view of a structure for connecting cremation ashes with a living plant according to the present invention illustrating placement of a vessel containing crematory remains within a hole drilled in a tree.
Figure 1B:
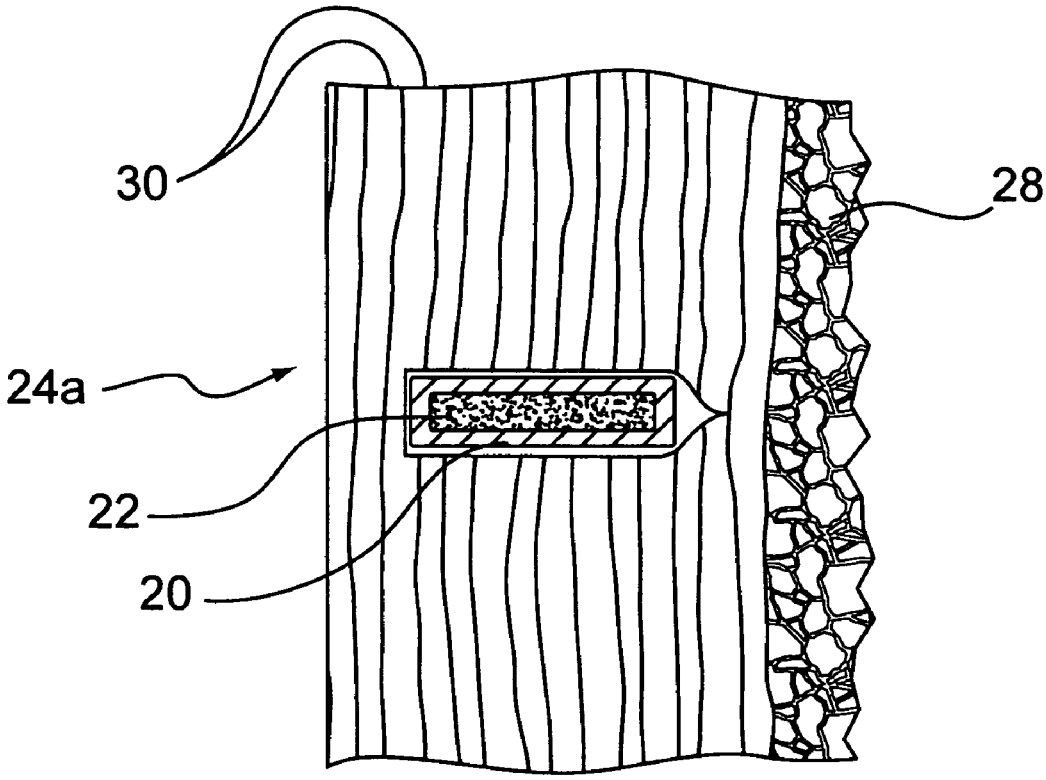
FIG. 1*b* is a sectional view of the structure in FIG. 1*a* after several years have passed and the tree has entombed the vessel containing crematory remains.

As illustrated in FIGS. 1*a* and 1*b*, a vessel 20 (a.k.a., urn) is prepared containing cremation remains 22 (a.k.a., cremation ashes). The cremation remains may be that of a human or a pet. Preparation of remains 22 in vessel 20 may occur at the crematorium or one may fill and prepare the vessel from ash remains they already have in their possession. The size, form and composition of vessel 20 are selected based on the size and type of living plant which remains 22 will be connected. In this particular embodiment, the plant is a tree 24*a*. Tree 24*a* may be a tree for which the deceased had a particular attachment to during life and that grows near their home or it may be a tree that is growing in a particular cemetery for the purpose of acting as a living memorial. A cavity 26 is created in a portion of tree 24*a* as shown in FIG. 1*a*. Cavity 26 may be created by drilling, cutting, sawing or any other means for creating an appropriately shaped cavity in a portion of tree 24*a*. Cavity 26 goes through bark 28 and into growth rings 30. Vessel 20 containing remains 22 is placed within cavity 26. Over time as shown in FIG. 1*b*, tree 24*a* grows outward and around the exposed end of vessel 20 entombing the remains. Remains 22 are surrounded by growth rings 30 and connected to tree 24*a* through vessel 22.

Figure 2A:
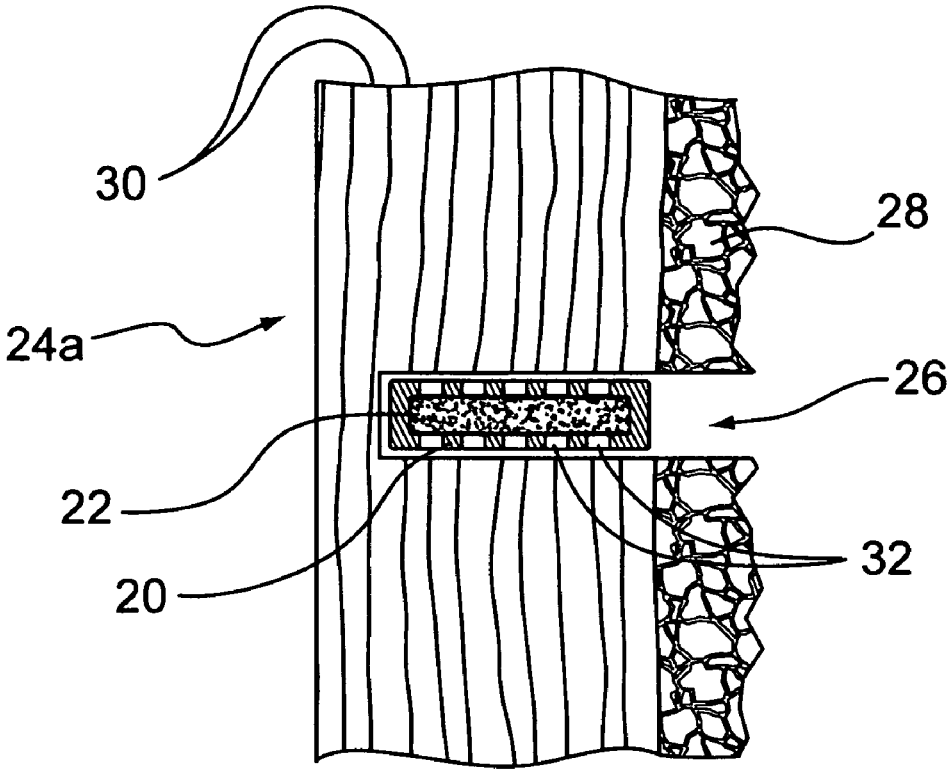
FIG. 2*a* is a sectional view of a porous vessel containing ashes that has been placed within a hole drilled in a tree.
Figure 2B:
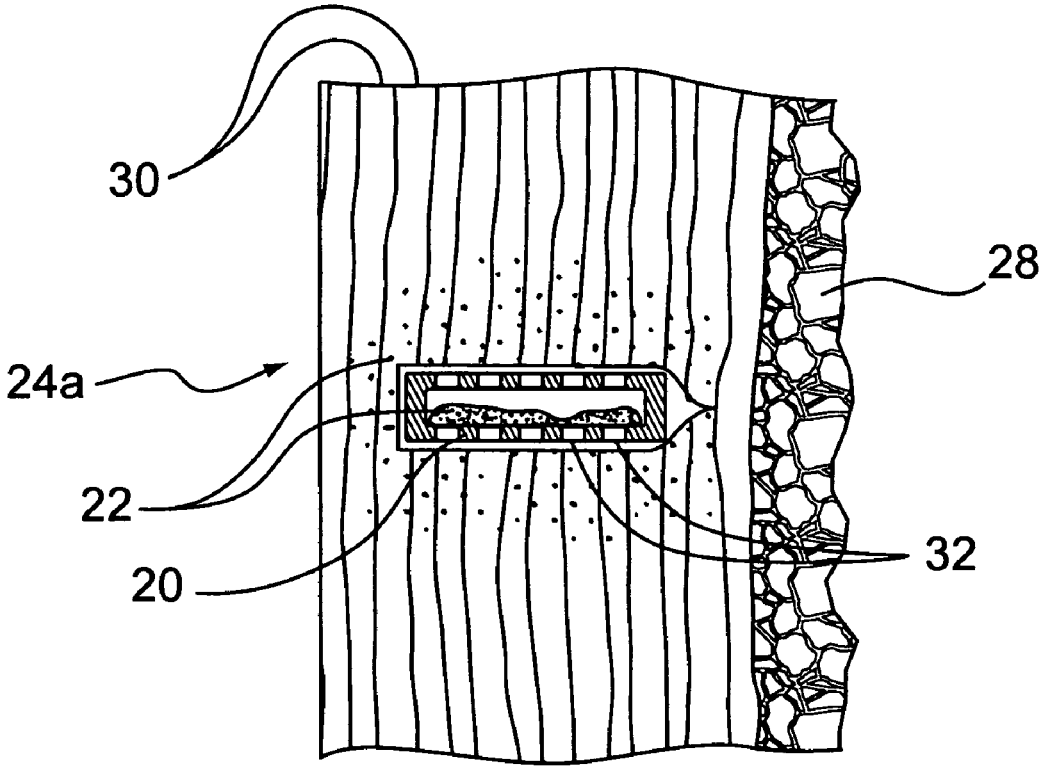
FIG. 2*b* is a sectional view of the structure in FIG. 2*a* after several years have passed, the tree has entombed the vessel and a portion of the ashes have been assimilated into the tree.

As illustrated in FIGS. 2*a* and 2*b*, cremation remains 22 may be more integrally connected with the living plant by allowing some of the remains to pass through the walls of vessel 20 and into the plant. In this embodiment as shown in FIG. 2*a*, vessel 20 is a porous vessel with pores 32. Vessel 20 contains cremated remains 22. A cavity 26 is created in tree 24*a* and vessel 20 is placed within the cavity. Over time as shown in FIG. 2*b*, tree 24*a* grows around vessel 20. Fluids or sap from within tree 24*a* pass through pores 32 of vessel 20 and mixes with remains 22. Remains 22 diffuse into the sap and are transported from vessel 20 throughout tree 24*a*. This creates an integral connection between remains 22 and tree 24*a* by allowing some of the remains to be assimilated into the tree as it grows.

Figure 3A:
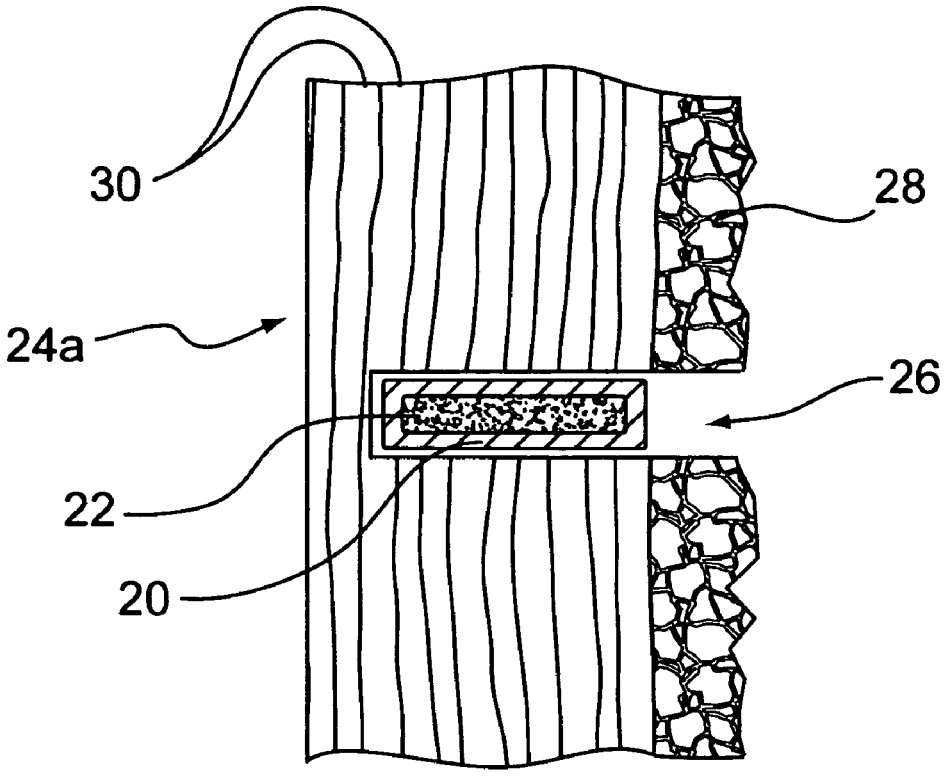
FIG. 3*a* is a sectional view of a biodegradable vessel containing ashes that has been placed within a hole drilled in a tree.
Figure 3B:
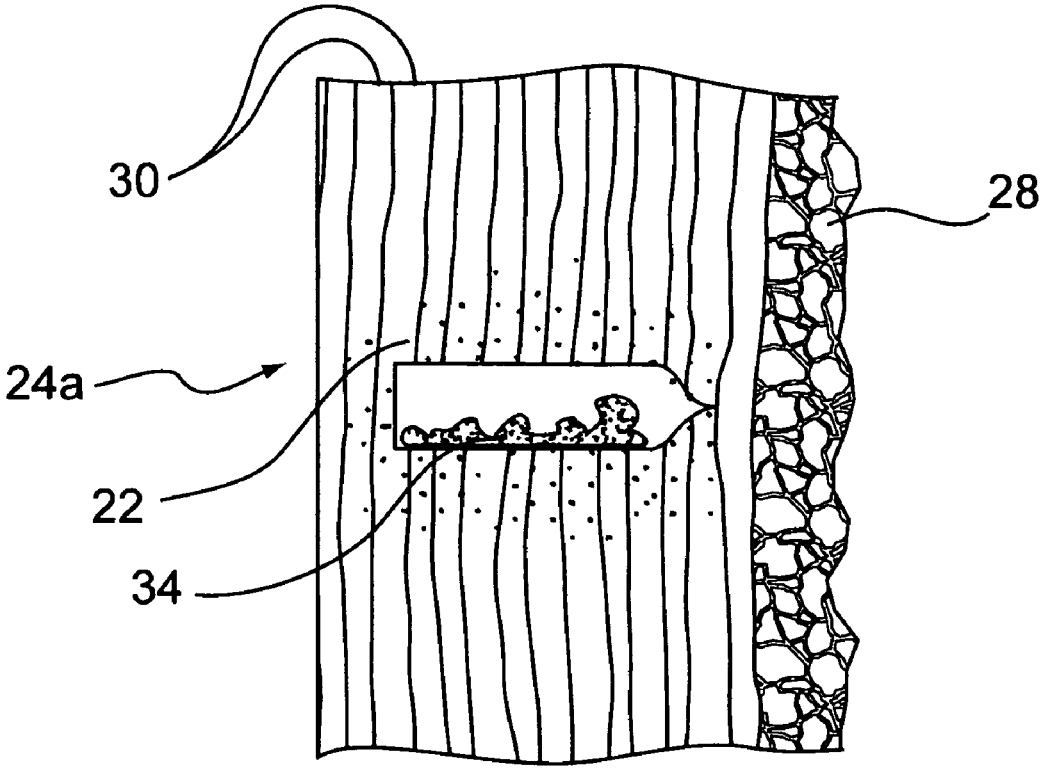
FIG. 3*b* is a sectional view of the structure in FIG. 3*a* after several years have passed, the tree has entombed the remains, the vessel has degraded, and a portion of the ashes have been assimilated into the tree.

Another embodiment of the present invention that allows for remains 22 to be assimilated into tree 24*a* as it grows is illustrated in FIGS. 3*a* and 3*b*. Here vessel 20 is a biodegradable vessel. As shown in FIG. 3*a*, vessel 20 containing cremated remains 22 is placed in cavity 26 created within tree 24*a*. Over time as shown in FIG. 3*b*, tree 24*a* grows around vessel 20. Fluids or sap from within tree 24*a* come in contact with vessel 20, breaking it down into a mixture of remains 22 and degrade vessel 34. Vessel 20 may be fabricated from any number of biodegradable materials including but not limited to sugars, starches, wood dust held together by water soluble glue or other suitable biodegradable material. Remains 22 then diffuse into the sap and are transported throughout tree 24*a*.

Figure 4A:
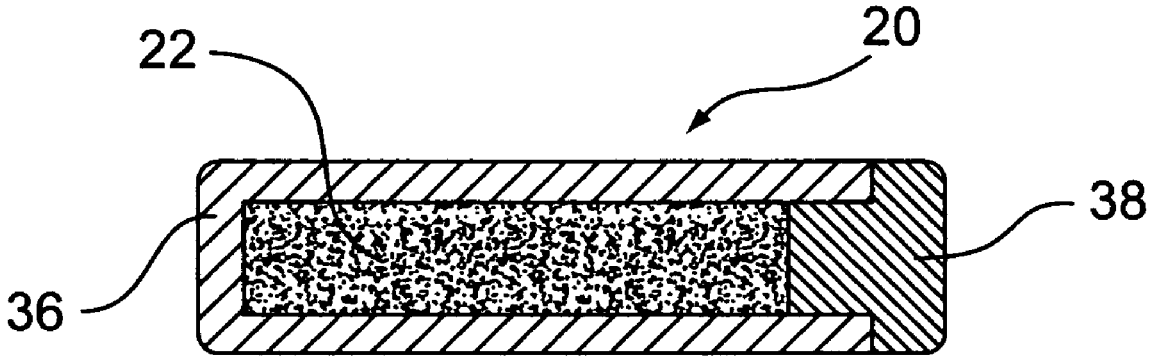
FIG. 4*a* is a sectional view of a vessel for holding cremated remains according to one embodiment of the present invention.
Figure 4B:
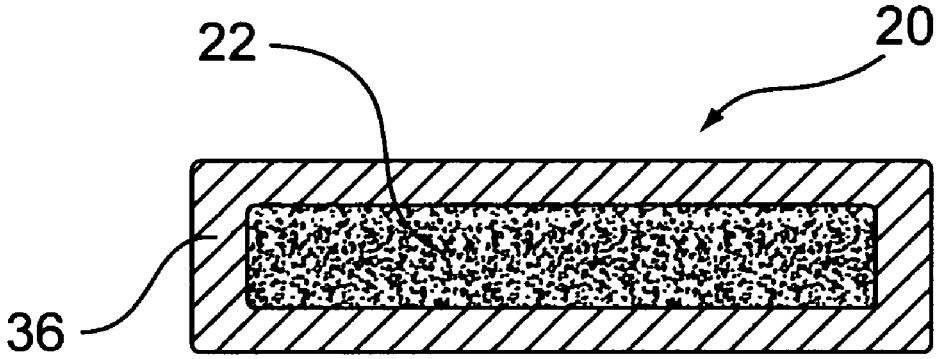
FIG. 4*b* is a sectional view of a vessel for holding cremated remains according to another embodiment of the present invention.
Figure 4C:
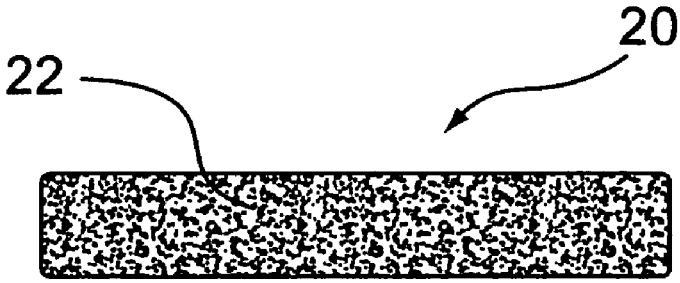
FIG. 4*c* is a sectional view of a vessel for holding cremated remains according to yet another embodiment of the present invention.

FIGS. 4*a*-4*c* illustrate several types of vessels 20 that may be used for placement of cremated remains 22 within a cavity created within a plant. FIG. 4*a* shows a vessel 20 that comprises a containment element 36 and a cap 38. After containment element 36 is filled with cremated remains 22, cap 38 is used to seal in the remains. The seal between containment element 36 and cap 38 may be made by screwing, pressing fitting, gluing or any other sealing technique. Vessel 20 may be fabricated from wood, plastic, metal, ceramic, organics, composites or other suitable materials. The materials may be porous or biodegradable. FIG. 4*b* shows a vessel 20 that includes a single containment element 36 that is formed around remains 22. Similarly, vessel 20 may be fabricated from a single containment element have an opening that is then sealed upon itself. Containment element 36 of vessel 20 may be only partially filled with remains 22. FIG. 4*c* shows a vessel 20 that is a composite structure 40 including remains 22. In structure 40, remains 22 may be mixed or layered with another material to create vessel 22. For example, maple sugar might be mixed with remains 22 to form a solid vessel 20 or plug that fits within a cavity of a maple tree. This vessel would be biodegradable and absorbed into the tree. The shape of vessels 20 have been shown primarily as cylinders. This shape easily fits within a hole drilled in a plant or tree. However, it is understood that any appropriately sized and shaped vessel that can fit within the cavity created is acceptable.

Figure 5A:
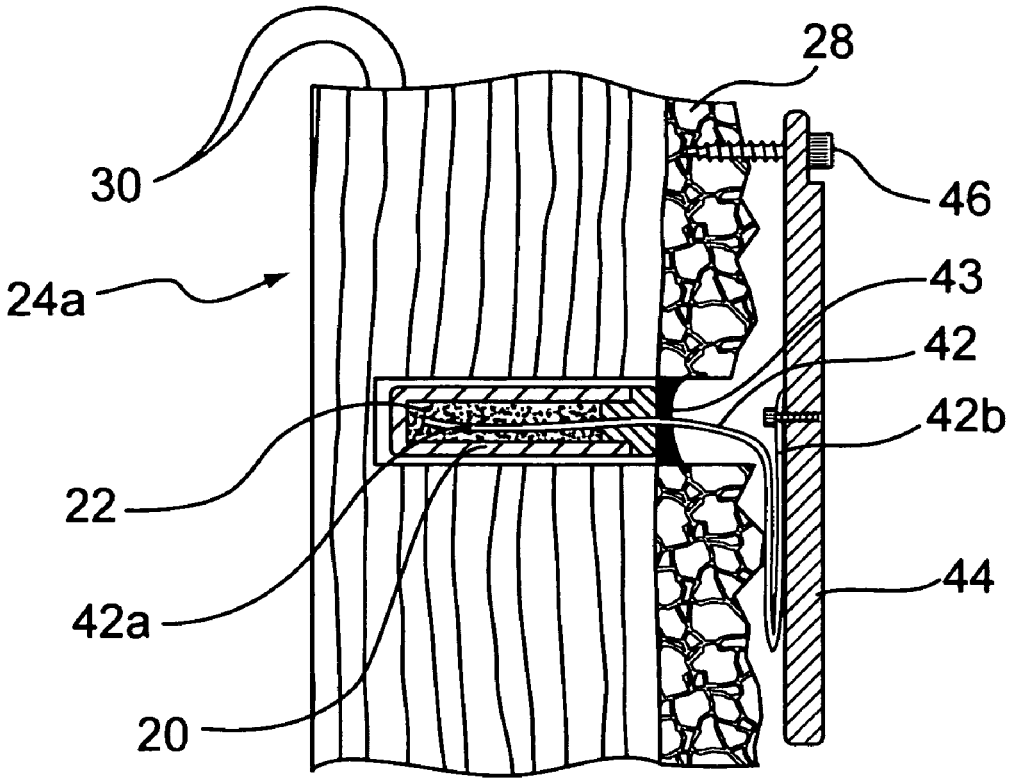
FIG. 5*a* is a sectional view of an embodiment of the present invention in which the vessel with crematory ashes includes a link, the vessel placed within a hole drilled in a tree.
Figure 5B:
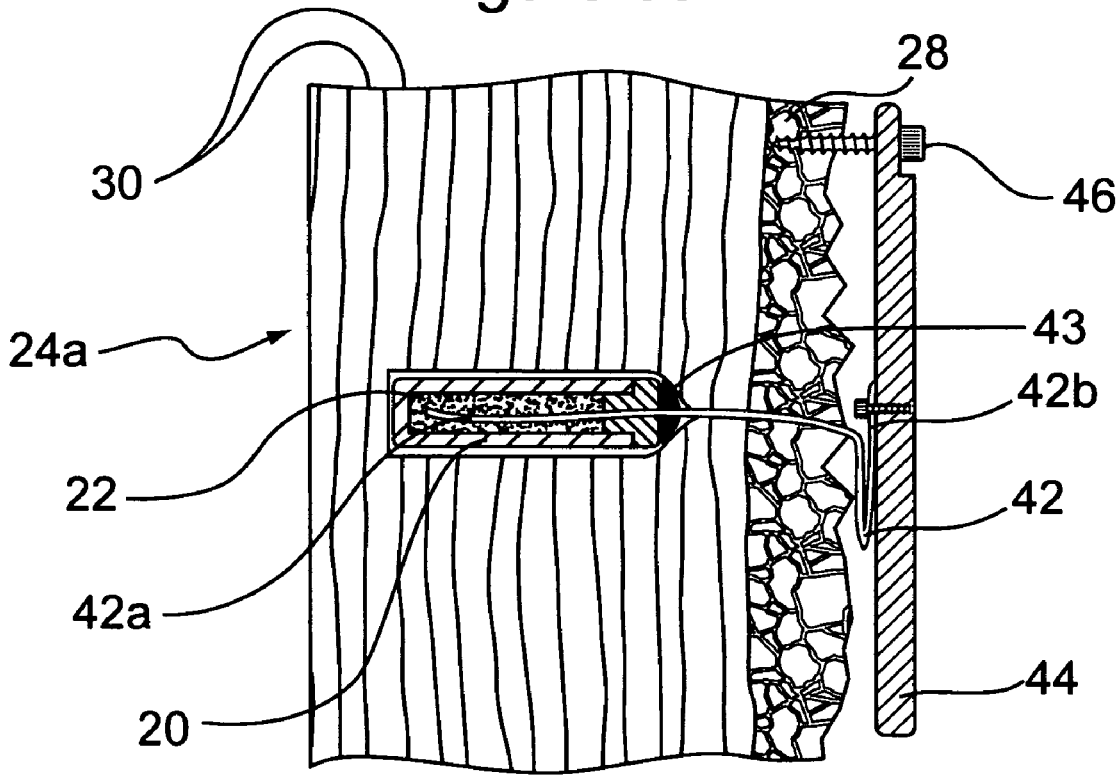
FIG. 5*b* is a sectional view of the structure in FIG. 5*a* after several years have passed, the tree has entombed the remains and the link extends between the ashes and a memorializing plaque.

FIGS. 5*a* and 5*b* illustrate the addition of a link 42 to the structure for connecting cremated remains 22 with the living plant, here a tree 24*a*. Link 42 offers an additional way of connecting to remains 22. As shown in FIG. 5*a*, vessel 20 containing cremated remains 22 is placed in cavity 26 created within tree 24*a*. Link 42 has a first end 42*a* and second end 42*b*. First end 42*a* is in contact with cremated remains 22. Link 42 may extend from vessel 20 or from within the vessel itself. Second end 42*b* extends outward from tree 24*a* through cavity 26. A sealant 43 may be applied to fill a portion of cavity 26, or around link 42, to seal out moisture or insects from getting into the cavity. Sealant 43 may be chosen from the group of materials including, but not limited to a caulking compound, putty, wax, PLASTIC WOOD® or tar based compounds. Although first shown in this embodiment, sealant 43 may be used in any of the embodiments of the present invention. Over time as shown in FIG. 5*b*, tree 24*a* grows around vessel 20 and around link 42. Link 42 may be a flexible cord, a rope, a wire or other material. At any time, link 42 extending from tree 24*a* may be touched by a love one to connect physically and spiritually with the deceased's ashes.

In alternative embodiment, vessel 20 containing cremated remains 22 could be inserted into cavity 26 so that link 42 fits within the cavity and makes a direct connection with tree 24*a*. Vessel 20 could also have a link 42 that passes through both ends of the vessel so that the link may contact tree 24*a* at one end and simultaneously have the other end of the link extend outward from the tree for human contact.

Additionally, one may wish to provide a memorial structure 44 as illustrated in FIGS. 5*a* and 5*b*. Memorial structure 44 may be a plaque, photo or other appropriate structure for commemorating the life of the deceased. Memorial structure 44 may be attached to the link's second end 42*b* extending from tree 24*a*. Memorial structure 44 may be attached to tree 24*a* by a screw 46 or other fastener. Sufficient length should be provided for link 42 so that as tree 24*a* grows the connection with memorial structure 44 is kept intact. The overall structure provides for a connection through link 42 between remains 22 and memorial structure 44. A connection is also made between remains 22 and tree 24*a* via vessel 20 and link 42. Any of the vessels 20 previously described may be integrated with link 42.

Figure 6A:
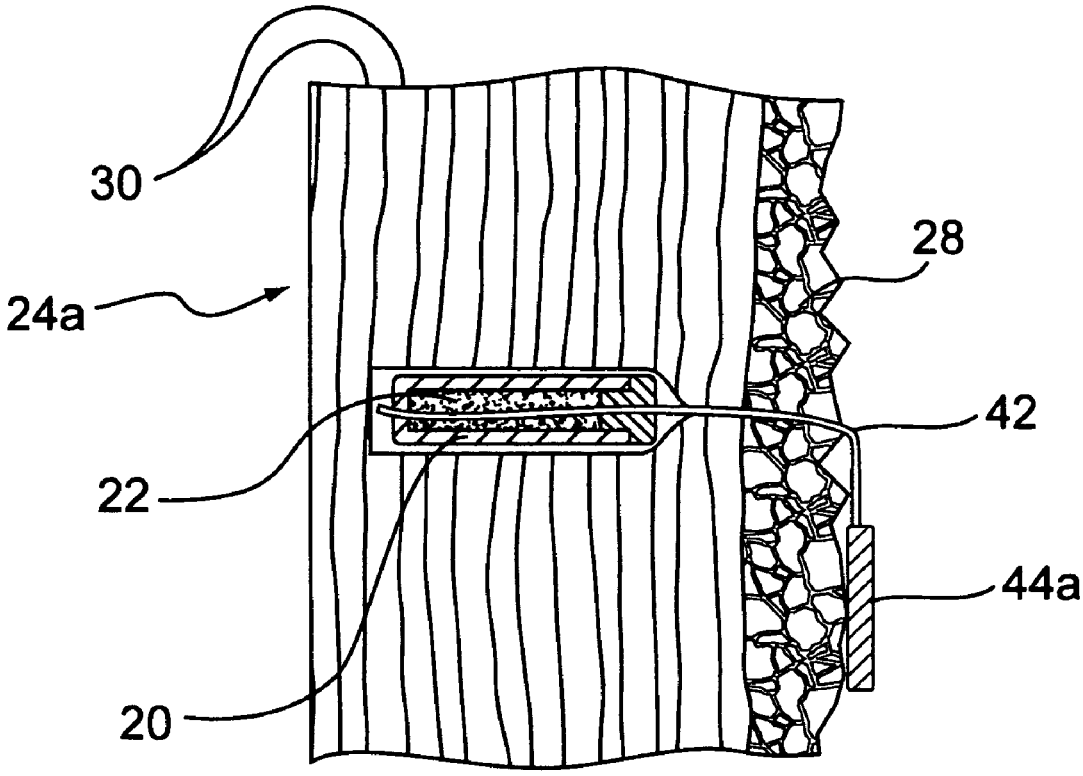
FIG. 6*a* is a sectional view of an alternative embodiment of the present invention with the link passing throughout the length of the vessel containing remains and the link extending outward from the tree to provide a portion of the link for touching by a loved one.
Figure 6B:
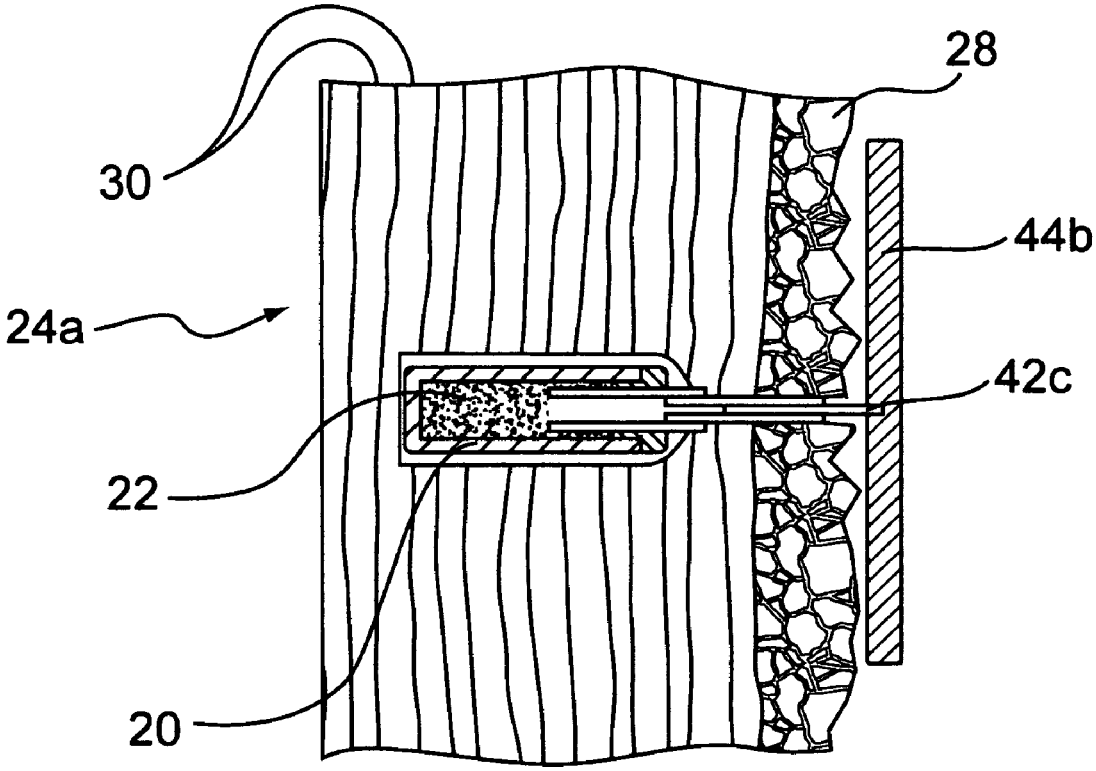
FIG. 6*b* is a sectional view of an alternative embodiment of the present invention with the link being a telescoping connection to the memorial structure.

FIGS. 6*a* and 6*b* illustrate two other embodiments for a memorial structure 44 attached to a link 42 that connects with cremated remains 22. FIG. 6*a* shows a pendant 44*a* for memorializing the deceased freely hanging from link 42. FIG. 6*b* shows a telescoping link 42*c* with a memorial plaque 44*b* attached to the link. This structure also allows for keeping an intact connection between cremated remains 22 and memorial structure 44 as tree 24*a* grows outward.

Figure 7A:
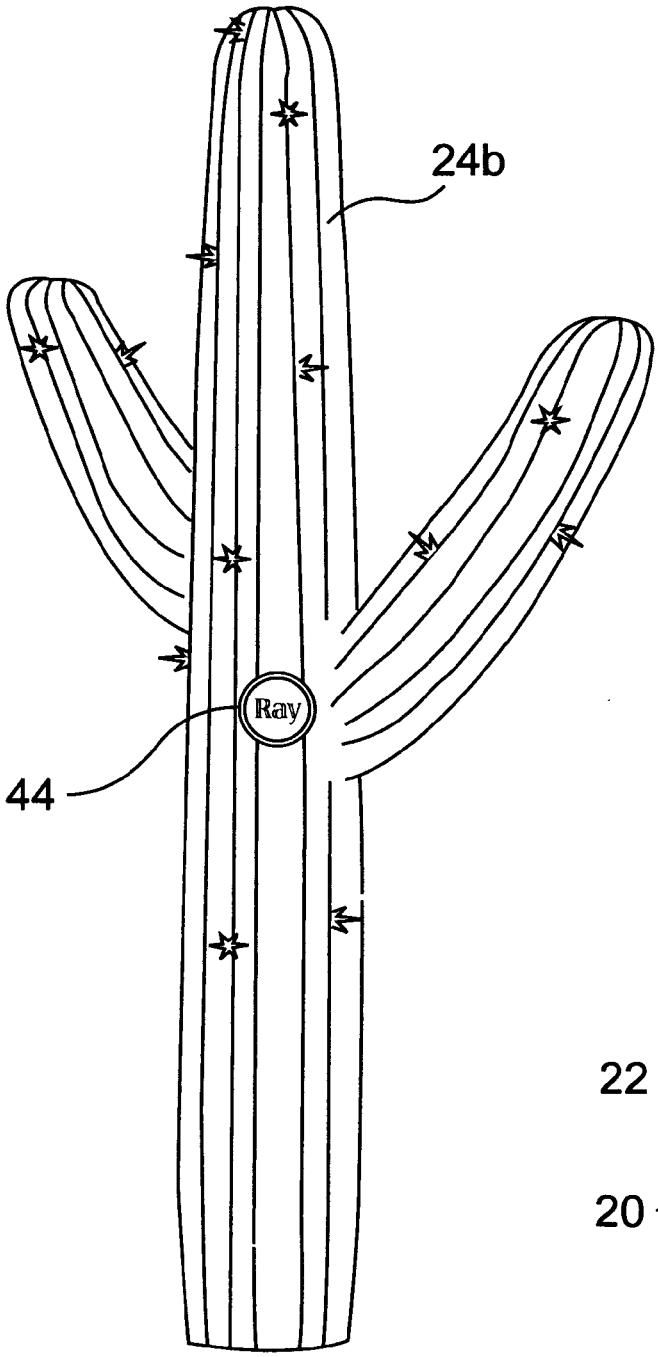
FIG. 7*a* is a side elevation view of a cactus connected with cremated remains.
Figure 7B:
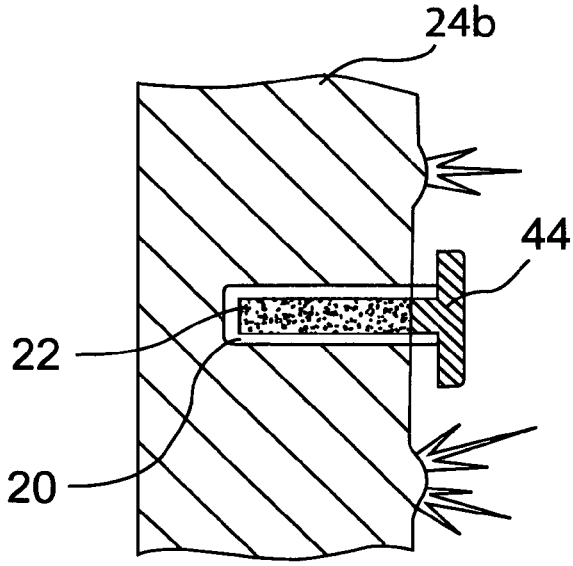
FIG. 7*b* is a sectional view of a vessel containing remains connected to a cactus.

FIGS. 7*a* and 7*b* illustrate yet another embodiment where vessel 20 containing cremated remains 22 is placed partially within cavity 26 cut within the plant. Here the plant is a cactus 24*b*. Vessel 20 is linked directly to a memorial structure 44. Cactus 24*b* may not totally entomb vessel 20, but rather seal around it. This type of connecting structure works well for a saguaro cactus and other similar plants, plants where the diameter does not grow rapidly relative to its height. Vessel 20 could be a non-biodegradable, biodegradable or porous vessel. Sealant may also be used at the opening of the cavity to protect against bugs, microbes and moisture.

Figure 8:
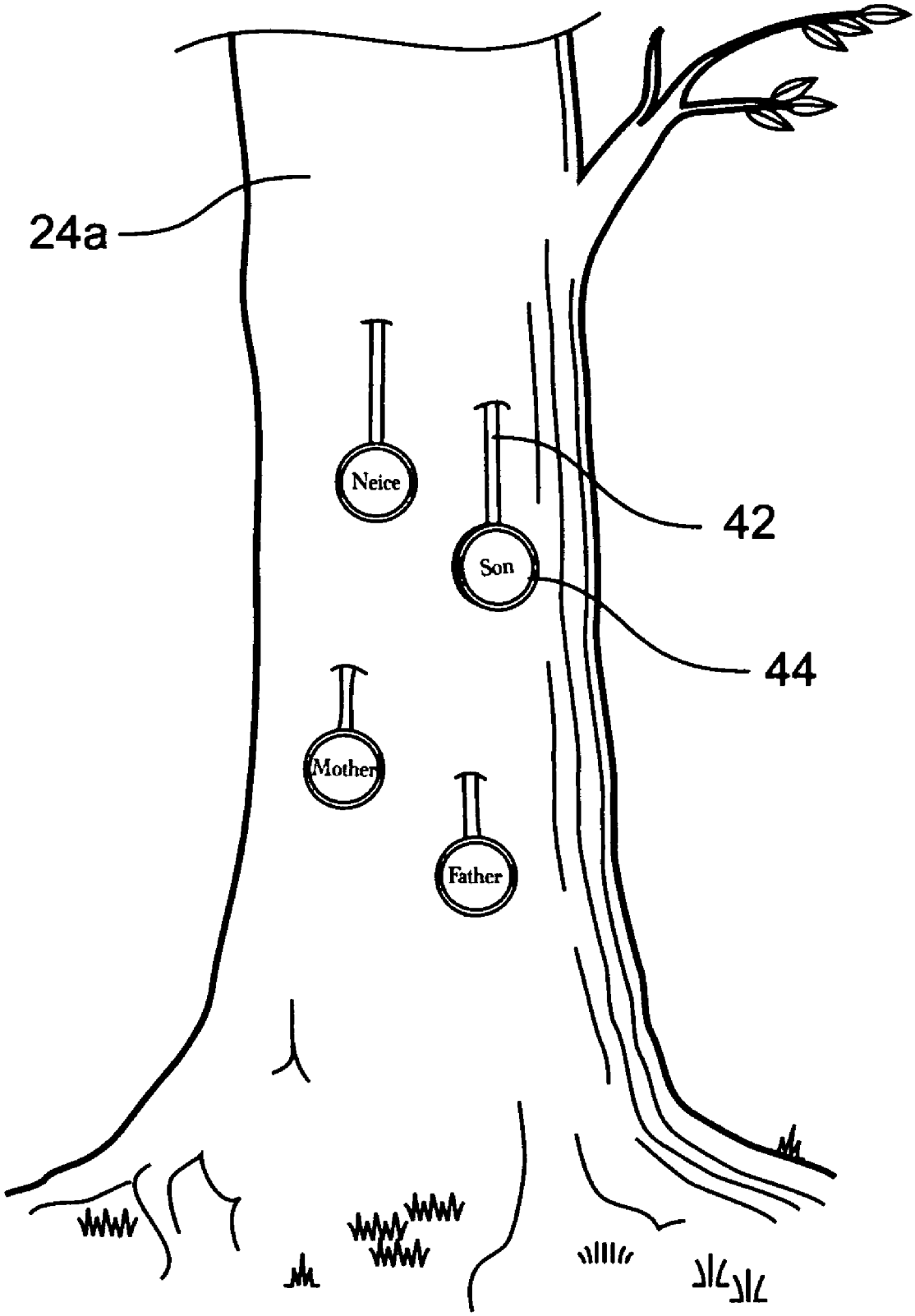
FIG. 8 is a side elevation view of a family burial tree containing multiple apparatus for connecting multiple remains within one tree.

FIG. 8 illustrates the structure of a family burial tree. It is possible to connect ash remains from several deceased humans or pets to one living plant. Such a structure is an important in perpetuating the concept of family after death. Tree 24*a* may reside in ones back yard or in a cemetery specifically designed for creating a connection between multiple deceased individuals and living plants. As each pet or person is cremated, a portion of their ashes may be placed within a cavity created within tree 24*a*. Connected to the remains and exiting from tree 24*a* is a link 42 with a memorial structure 44 identifying each individual's remains. Since many trees may live for hundreds of years, it is possible to combine many generations into one living tree. If for some reason the tree dies, or one is forced to move, that portion of the tree containing the remains may be cut down and turned into a memorial that can be kept in ones home and moved as needed. The cut portion of the tree may be turned into a piece of furniture or sculpture with the remains intact.

Figure 9A:
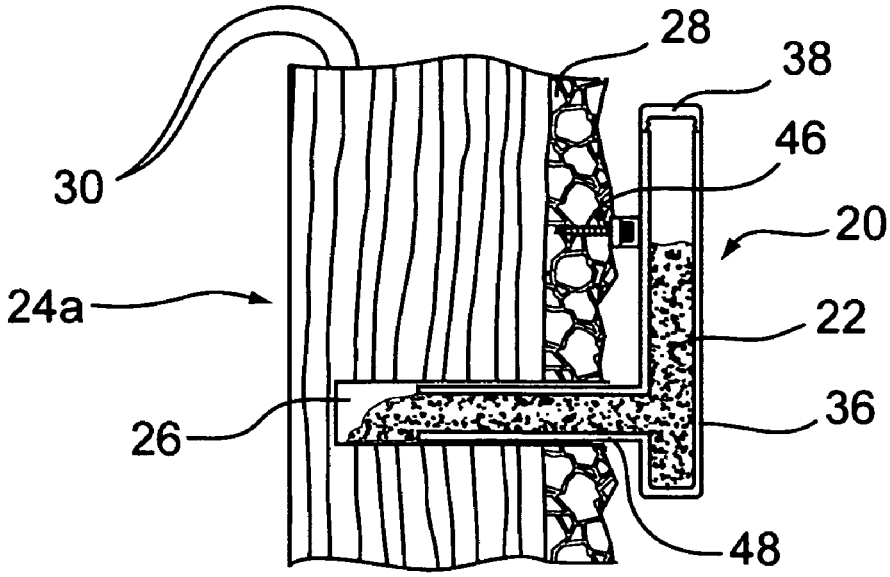
FIG. 9*a* is a sectional view of a memorializing vessel according to the present invention attached to the outside of a tree and having a tube linking ashes from within the vessel to a cavity created within the tree.
Figure 9B:
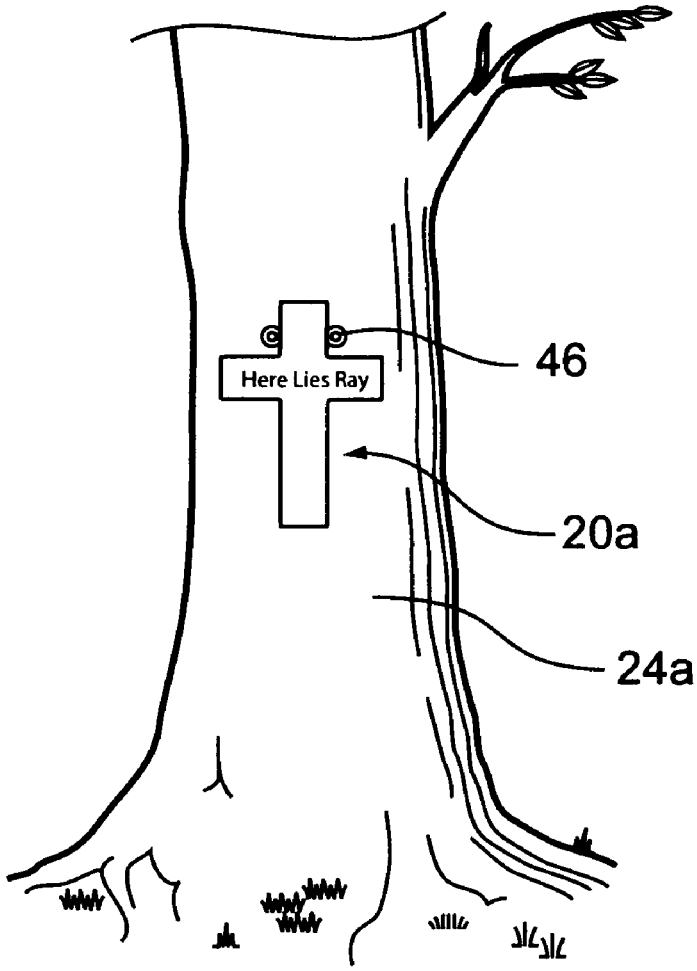
FIG. 9*b* is a side elevation view of the memorializing vessel in FIG. 9*a;*

As illustrated in FIGS. 9*a* and 9*b*, vessel 20 containing cremated remains 22 may reside outside the plant or tree 24*a* and a connection made between the vessel and tree. In this particular embodiment of the present invention vessel 20 (a.k.a., urn) takes the form of a cross 20*a*. In essence, vessel 20 becomes the memorial structure 44. Vessel 20 comprises a containment element 36 and a cap 38. Vessel 20 may be fabricated from wood, metal, ceramic, organics, composites or other suitable materials. Cremated remains 22 are placed within containment element 36 and sealed with cap 38. Near the base of vessel 20, the vessel further comprises a tube 48, functioning as a link, to fit within a cavity 26 cut within tree 24*a*. Vessel 20 is attached to tree 24*a* by a screw 46 or other fastener. As time passes, living tree 24*a* grows around tube 48. Cremated remains 22 connect with tree 24*a* through tube 48. Some portion of remains 22 may be assimilated into tree 24*a*.

Figure 10A:
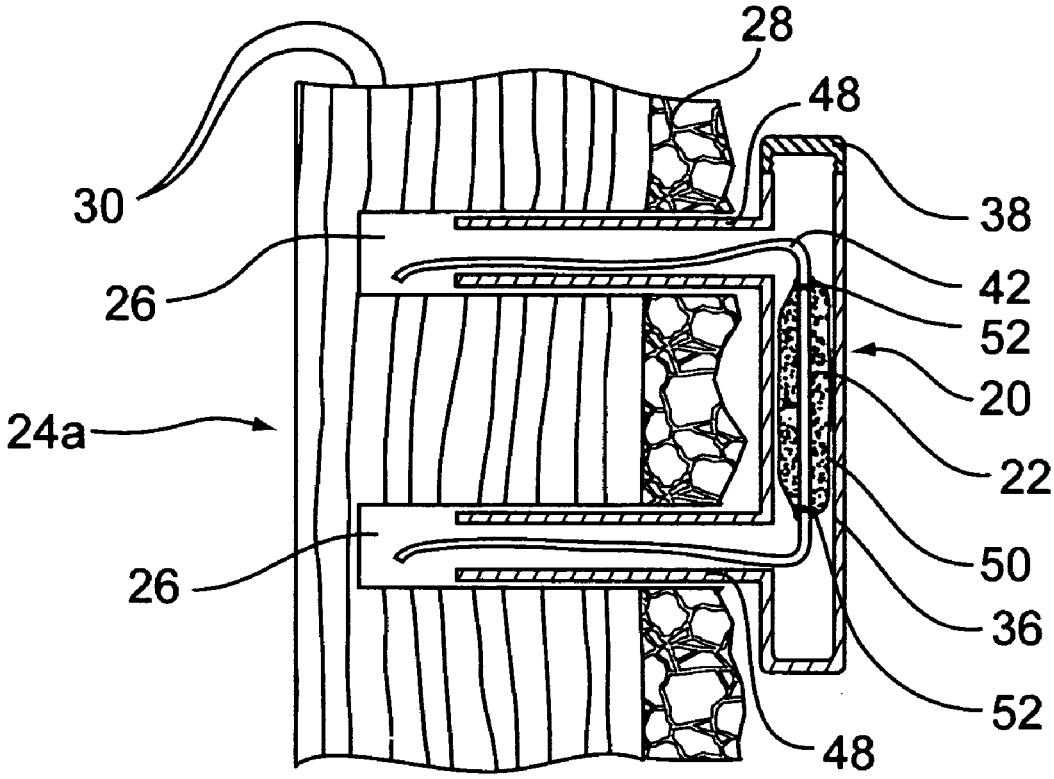
FIG. 10*a* is a sectional view of a structure according to the present invention illustrating a cord linking the ashes contained within a vessel to two recessed cavities within a tree.
Figure 10B:
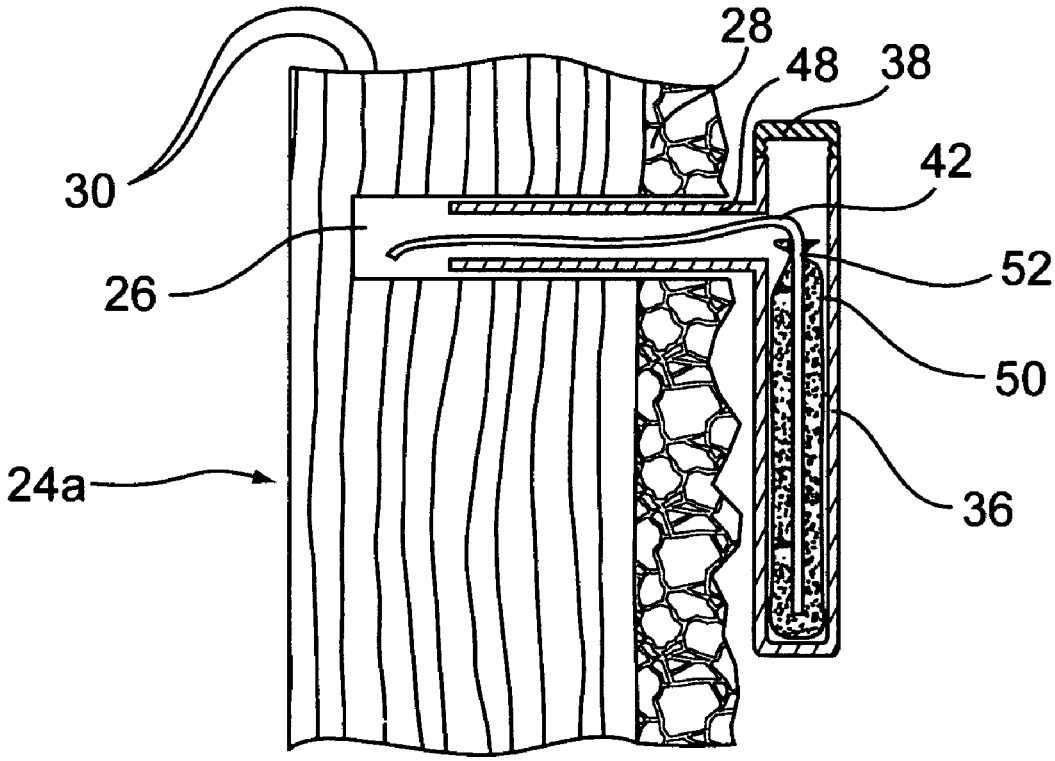
FIG. 10*b* is a sectional view of a structure according to the present invention illustrating a bag and link arrangement to connect ashes from a vessel to the tree.

FIGS. 10*a* and 10*b* illustrate two additional embodiments for housing cremated remains 22 outside a living plant and making a connection to the plant. As shown in FIG. 10*a*, vessel 20 has two tubes 48, functioning as two links, that are placed within two cavities 26 cut within a tree 24*a*. Vessel 20 may have an additional means for attachment to tree 24*a* or the two tubes 50 may fit snuggly in cavities 26 to hold the vessel to the tree. Cavities 26 may also be sealed with a sealant. Cremated remains 22 are housed within containment element 36 and protected from the environment by cap 38. Cremated remains 22 are placed within a bag 50 that has seals 52. A second link 42, which may be a flexible cord, rope or wire, passes through remains 22, through seals 52, through tubes 48 and into cavities 26 to make contact with tree 24*a*. In a different variation FIG. 10*b* shows vessel 20 with a single tube 48 near its top. Cremated remains 22 are housed within containment element 36 and protected from the environment by cap 38. Cremated remain 20 are placed within a bag that has a tied seal 52. Link 42 in contact with remains 22 passes through seal 52 and connects with tree 24*a* in cavity 26.

Figure 11A:
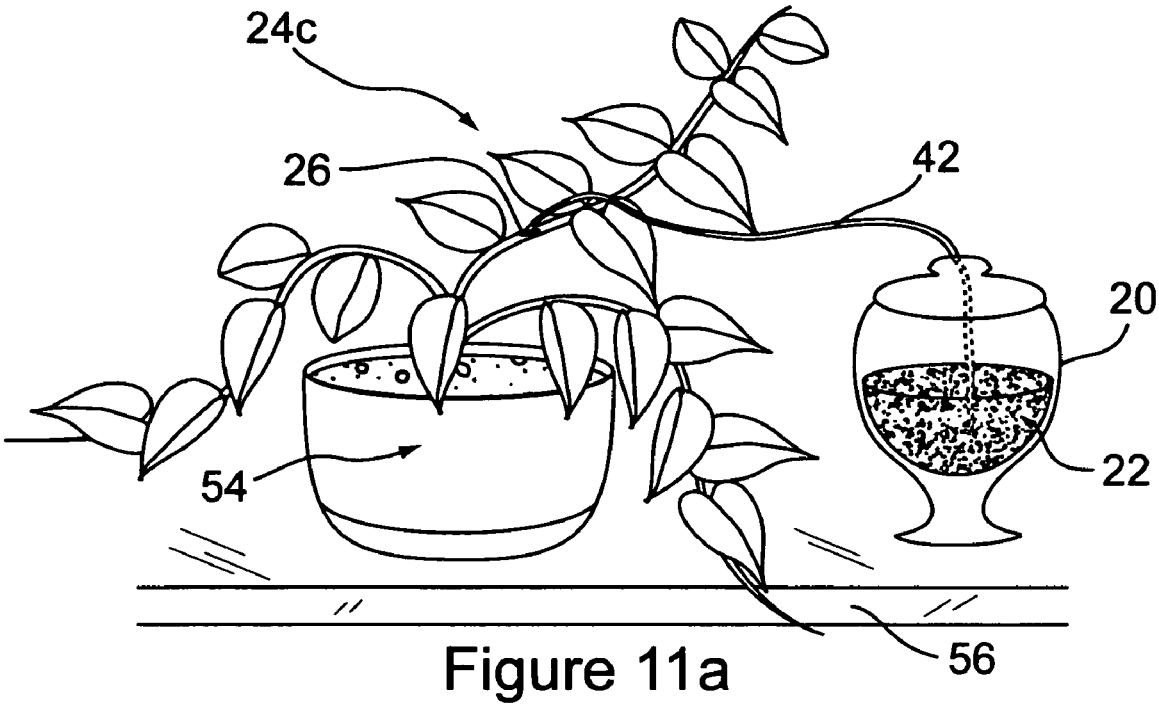
FIG. 11*a* is a side perspective view illustrating grafting a cord to a house plant, the cord linked to ashes in an urn.
Figure 11B:
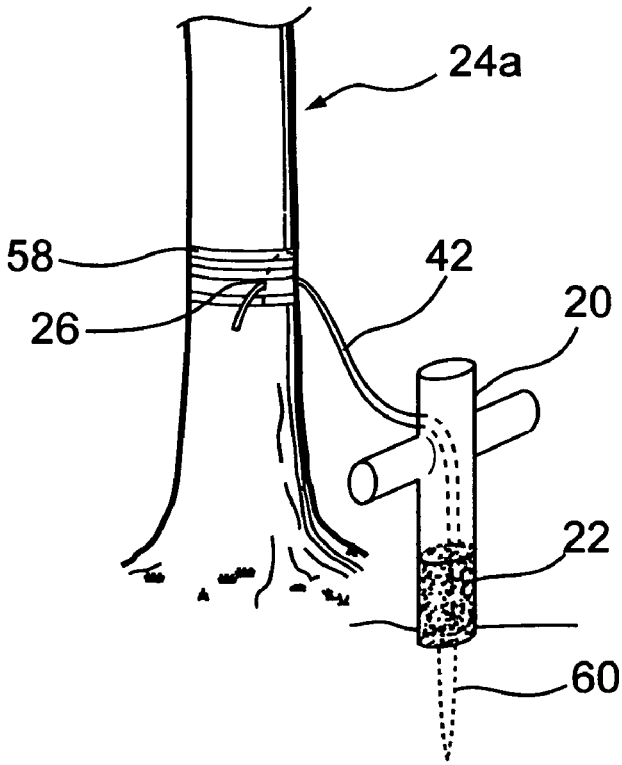
FIG. 11*b* is a side perspective view illustrating grafting a cord to a tree, the cord linked to ashes in a memorializing vessel.

Grafting may also be used as a way of connecting cremation remains with a living plant according to the present invention. Instead of grafting a portion of another plant to the living plant on wishes to graft to, a link connecting with the cremated remains is grafted to the living plant. FIGS. 11*a* and 11*b* illustrate two structures according to this embodiment. FIG. 11*a* shows a house plant 24*c*, such as ivy, growing in a pot 54 on a table 56 within a home. A vessel 20 (a.k.a., urn) is placed beside plant 24*c* on table 56. Vessel 20 contains cremated remains 22. A link 42 in contact with remains 22 connects between the remains and plant 24*c*. Link 42 is placed within a cavity 26 cut with living plant 24*c*. Over time, cavity 26 seals and grows around link 42 to create a connection between cremated remains 22 and plant 24*c*. Similarly, FIG. 11*b* shows grafting of a link 42 to a young tree 24*a*. A cut is made to create cavity 26 within tree 24*a*. Link 42 is placed within cavity 26. Cavity 26 is closed and grafting tape 58 used to seal the cavity. An additional sealant or wax may also be used. Over time, tree 24*a* will grow around link 42. Link 42 extends into a vessel 20 that contains cremated remains 22. Vessel 20 may take the form of a memorializing structure and be held in place by a stake 60 attached to the vessel that is pushed into the ground. As tree 24*a* grows to be large enough, vessel 20 may be attached directly to the tree.

Figure 12A:
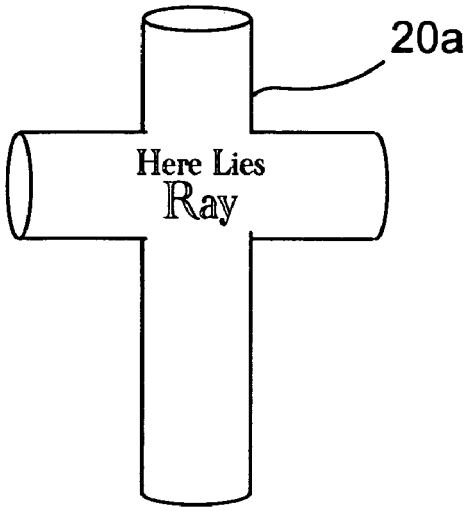
FIG. 12*a* is a side elevation view of a memorializing vessel designed as a cross.
Figure 12B:
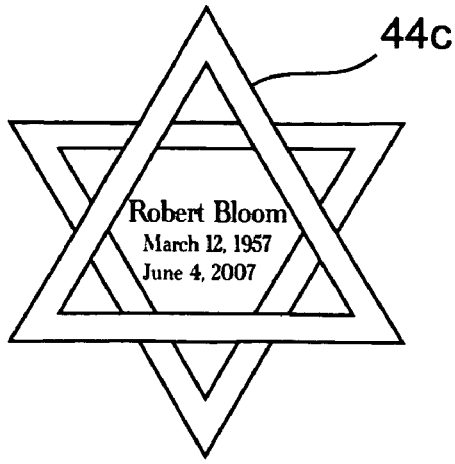
FIG. 12*b* is a side elevation view of a memorial structure designed in the shape of the Star of David.

FIGS. 12*a-d* show several examples of memorializing structures that may be used to locate or store remains that connect to a plant. FIG. 12*a* illustrates a vessel 20*a* that both stores cremated remains and memorializes the deceased's Christian faith. FIG. 12*b* illustrates a memorializing plaque structure 44*c* that symbolizes the deceased's Jewish faith.

Figure 12C:
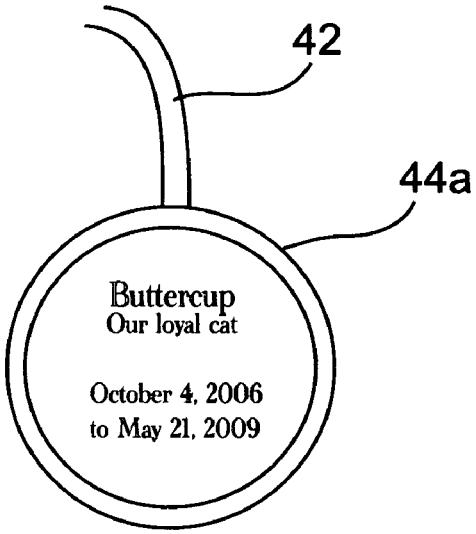
FIG. 12*c* is a plan view of a disc shaped memorializing pendant that is attached to a cord.
Figure 12D:
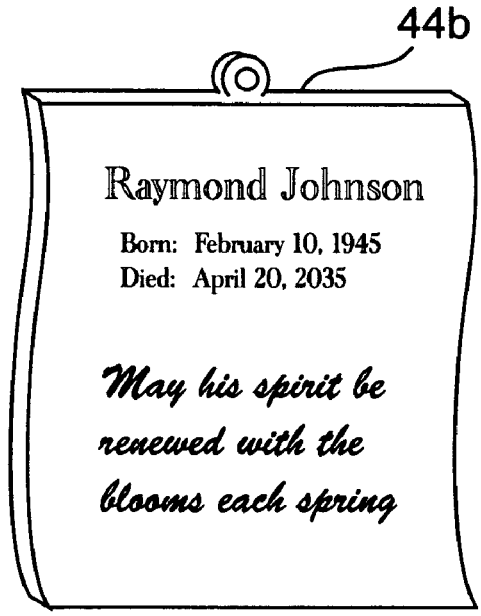
FIG. 12*d* is a plan view of a memorializing plaque that may be attached to a cord.

FIG. 12*c* illustrates a pendant 44*a* that may be attached to a link locating the remains of a cat's cremated remains entombed within a tree. FIG. 12*d* illustrates a design for a plaque 44*b* that may be hung on a tree locating and memorializing a deceased's remains.

The embodiments of the current invention that do not entomb the cremated remains within a plant offer another advantageous feature not provided by the prior art in that the link between the living plant and remains can be severed and the remains moved to link with a new plant. This feature is nice in that it allows for a loved one to take ashes with them if they move and create a new link to a living plant for the deceased's remains. For example in FIGS. 11*a* and 11*b* the grafted link would be cut near the plant and may be re-grafted to a new plant.

Throughout the present invention cremated remains have been connected with the living plant. In an alternative embodiment, it is possible that a keepsake of the deceased's or a piece of the deceased's body such as hair could be placed with a vessel. A connection with the keepsake or other artifact from the deceased can be made in a similar manner with the living plant.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

What is claimed is:

1. A structure for connecting cremated remains to a living plant, comprising: a vessel holding said cremated remains and a cavity created within said plant, wherein said vessel is at least partially contained within said cavity, and wherein said cremated remains are at least partially contained within said cavity.

2. A structure as recited in claim 1, further comprises a link extending from said cremated remains to the outside of said plant.

3. A structure as recited in claim 2, wherein said link is a flexible cord.

4. A structure as recited in claim 2, wherein said link telescopes to increase in length.

5. A structure as recited in claim 2, further comprising a memorial structure attached to said link outside said plant.

6. A structure as recited in claim 1, further comprising a sealant applied to a portion of said cavity for sealing out moisture, microbes and insects.

7. A structure as recited in claim 1, wherein said vessel is at least one from the group including a non-biodegradable vessel, a biodegradable vessel and a porous vessel.

8. A structure as recited in claim 1, wherein said vessel is fabricated out of at least one from the group including wood, plastic, metal, ceramic, organics, composites and a composite structure including said remains.

9. A structure as recited in claim 1, wherein said plant is at least one from the group including a tree, a cactus, a vine and a house plant.

10. A structure as recited in claim 1, wherein said remains are substantially contained within said cavity.

11. A structure as recited in claim 1, wherein said vessel is entirely contained within said cavity.

12. A structure for connecting cremated remains to a living plant, comprising: a vessel containing cremated remains and a flexible cord with first and second ends, said first end in contact with said cremated remains and said second end placed in a cavity created within said plant, wherein said vessel is at least partially contained within said cavity.

13. A structure as recited in claim 12, wherein said flexible cord is at least one from the group including wire and organic fibers.

14. A structure as recited in claim 12, wherein said vessel is a memorial structure.

15. A structure as recited in claim 12, further comprising a bag for holding said cremated remains within said vessel.

16. A structure as recited in claim 12, wherein said cremated remains are at least partially contained within said cavity.

17. A method of connecting cremated remains to a living plant, comprising:

providing said living plant, said cremated remains and a vessel; creating a cavity in said living plant; placing said cremated remains in said vessel; and placing said vessel in said cavity so that said cremated remains are at least partially placed in said cavity.

18. A method as recited in claim 17, wherein creating said cavity involves at least one from the group including drilling, sawing and cutting.

19. A method as recited in claim 17, further comprising providing a link that extends from said vessel.

20. A method as recited in claim 19, further comprising allowing said plant to grow around said link.

21. A method as recited in claim 17, further comprising providing a link that extends from within said vessel.

22. A method as recited in claim 21, further comprising allowing said plant to grow around said link.

23. A method as recited in claim 17, further comprising allowing said plant to grow around said cremated remains.

24. A method as recited in claim 17, further comprising attaching a memorial structure to said plant.

25. A method as recited in claim 24, further comprising providing a link that connects between said cremated remains and said memorial structure.

26. A method as recited in claim 17, further comprising allowing said vessel to degrade and said plant absorbing a portion of said cremated remains.

27. A method of connecting cremated remains to a living plant, comprising: providing said living plant, said cremated remains and vessel; placing said cremated remains in said vessel; creating a cavity within said plant; placing said vessel at least partially within said cavity so that a portion of said cremated remains is within said cavity; providing a link with first and second ends, said first end in contact with said cremated remains and said second end extending outward from said plant; attaching an identifying memorial structure to said second end; and allowing said plant to grow around said vessel.

28. A method as recited in claim 27, further comprising sealing a portion of said cavity to seal out moisture, microbes and insects.

29. A method as recited in claim 27, further comprising allowing said plant to grow completely around said vessel entombing said cremated remains.

30. A method as recited in claim 27, further comprising allowing said vessel to degrade and said plant absorbing a portion of said cremated remains.

31. A method of connecting cremated remains to a living plant, comprising: providing said living plant, said cremated remains and vessel; placing said cremated remains in said vessel, said vessel including a flexible cord with first and second ends, said first end in contact with said remains and said second end extending outward from said vessel; creating a cavity within a portion of said plant; placing said second end within said cavity; and allowing said plant to grow around said second end to create a connection between said plant and said remains.

32. A method as recited in claim 31, further comprising attaching said vessel to said plant.

33. A method as recited in claim 31, further comprising placing said vessel on a surface next to said plant.

* * * * *